US006659260B2

(12) United States Patent
Otsuka et al.

(10) Patent No.: US 6,659,260 B2
(45) Date of Patent: Dec. 9, 2003

(54) BANK NOTE PROCESSING APPARATUS AND BANK NOTE PROCESSING METHOD

(75) Inventors: Toru Otsuka, Kanagawa-ken (JP); Morimasa Miyashita, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 93 days.

(21) Appl. No.: 09/978,670

(22) Filed: Oct. 18, 2001

(65) Prior Publication Data

US 2002/0066637 A1 Jun. 6, 2002

(30) Foreign Application Priority Data

Nov. 6, 2000 (JP) ..... P2000-338213

(51) Int. Cl.[7] ..... G07D 7/00; B07C 5/34
(52) U.S. Cl. ..... 194/302; 209/900; 209/534
(58) Field of Search ..... 270/58.33, 58.34, 270/58.18, 52.18; 271/287, 298, 65, 207; 194/302; 209/534, 900

(56) References Cited

U.S. PATENT DOCUMENTS 4,690,268 A * 9/1987 Ueshin ..... 198/399
5,247,159 A * 9/1993 Yuge et al. ..... 235/379
5,522,511 A * 6/1996 Sakoguchi et al. ..... 209/534
6,460,705 B1 * 10/2002 Hallowell ..... 209/534
2001/0028145 A1 * 10/2001 Fukatsu et al. ..... 271/186
2002/0104785 A1 * 8/2002 Klein et al. ..... 209/534
2002/0153290 A1 * 10/2002 Otsuka ..... 209/534
2002/0153291 A1 * 10/2002 Otsuka ..... 209/534

FOREIGN PATENT DOCUMENTS

JP 54-51598 A * 4/1979 ..... G07D/9/00
JP 05-006478 1/1993 ..... G07D/9/00

* cited by examiner

*Primary Examiner*—Donald P. Walsh
*Assistant Examiner*—Mark J. Beauchaine
(74) *Attorney, Agent, or Firm*—Pillsbury Winthrop LLP

(57) ABSTRACT

A bank note processing apparatus comprises an insert port into which plural sheets of rectangular shaped bank notes having front/back and top/bottom extending in a longitudinal direction, a take-out portion for taking out the bank notes from the insert port with the top or bottom laid ahead one by one, a conveying path which then conveys the bank notes, a detector which detects information relative to the front/back and top/bottom of the bank notes being conveyed, a front/back reversing portion which selectively reverses the front/back of the bank notes based on the result of detection, first and second stackers which stack the selectively reversed bank notes, a sorter which sorts the bank notes being conveyed to the first or second stacker, and first and second banding portions which band the stacked bank notes for every prescribed number of sheets at the same position of one side of the longitudinal direction of the notes.

15 Claims, 9 Drawing Sheets

| FACE VALUE | FIRST KIND (PORTRATE : LEFT SIDE) ⇒ RIGHT BANDING | SECOND KIND (PORTRATE : RIGHT SIDE) ⇒ LEFT BANDING |
|---|---|---|
| 1, 000YEN | | ○ |
| 2, 000YEN | ○ | |
| 5, 000YEN | ○ | |
| 10, 000YEN | | ○ |

FIG.9

BANK NOTE PROCESSING APPARATUS AND BANK NOTE PROCESSING METHOD

CROSS-REFERENCE TO RELATED APPLICATION

This application is based upon and claims the benefit of priority from the prior Japanese Patent Application No. 2000-338213, filed on Nov. 6, 2000; the entire contents of which are incorporated herein by reference.

BACKGROUND OF THE INVENTION

1. Field of the Invention

The present invention relates to a bank note processing apparatus into which bank notes in plural kinds are inlaid through an insert port in a lump, the inserted bank notes are taken out of this insert port, front and back are uniformly arranged, classified by kind and stacked, and the stacked bank notes in specific kind are banded prescribed number of sheets by a paper strip, and a bank note processing method.

2. Description of the Related Art

In a conventional bank note processing apparatus, plural kinds of bank notes are inserted into an insert port in the mixed state with the front/back and the top/bottom not arranged uniformly, and the inserted bank notes are taken out on a conveying path one by one. Such features of bank notes conveyed as kind, front/back, top/bottom, etc. are detected and based on the result of this detection, the front/back of the bank notes are selectively reversed, and all reversed bank notes are sorted and stacked in prescribed stackers prepared for every kind of bank notes in the state with the front laid upward.

In particular, as a bank note processing apparatus having a function to band bank notes in specific kind with a paper strip, the bank note processing apparatus disclosed in Japanese Patent Disclosure (Kokai) No. 5-6478 is well known.

This bank note processing apparatus is equipped with two stackers for stacking bank notes in specific kind, and bank notes inserted with the front laid upward and the top laid ahead are stacked in one of the stackers and those bank notes inserted with the front laid upward and the bottom ahead are stacked in the other stacker. That is, the front/back and the top/bottom are arranged uniformly in respective stackers and then, the bank notes are banded with a paper strip in a banding portion provided corresponding to each stacker. At this time, bank notes in prescribed number of sheets are banded by winding a paper strip round them at a position one-sided to one of the longitudinal directions of the bank notes stacked.

However, in the above-mentioned conventional bank note processing apparatus, for example, bank notes stacked in each stacker are wound round with a paper strip at a position one-sided to the rear side of the apparatus and therefore, the top/bottom of bank notes stacked in one stacker and those of bank notes stacked in the other stacker are in the reversed state and the winding positions of both bundles of bank notes become different. Thus, when the winding positions of the paper strips differ, there is caused such a defect that, for example, a paper strip conceals figures and letters shown on bank notes.

Therefore, it is considered a method for winding a paper strip round a bundle of bank notes at the same position by arranging one of the banding devices provided to each stacker at the front side and the other banding device at the rear side. However, in order to adopt such a structure, there is such a problem that cost increases as it becomes necessary to provide banding devices in two different structures.

BRIEF SUMMARY OF THE INVENTION

An object of the present invention is to provide a bank note processing apparatus and a bank note processing method capable of arranging the front/back and the top/bottom of all bank notes and banding them at the same position without changing the structure of the apparatus.

According to the embodiment of the present invention, there is provided a bank note processing apparatus comprising an insert port into which plural sheets of rectangular shaped bank notes having the front/back and top/bottom extending along the longitudinal direction are inserted collectively; a take-out portion which takes the bank notes inserted into the insert port one by one with the top or bottom laid ahead; a conveying path which conveys the bank notes taken out of the take-out portion with the top or bottom laid ahead; a detector which detects information relative to the front/back and top/bottom of the bank notes being conveyed on the conveying path; a front/back reversing portion which selectively reverses the front/back of the bank notes being conveyed on the conveying path based on the result of detection by the detector; first and second stackers which stack the bank notes of which front/back were selectively reversed in the front/back reversing portion; a sorting portion which sorts the bank notes being conveyed into the first or the second stacker based on the result of detection by the detector; first and second banding portions which band the bank notes stacked in the first and the second stackers for a prescribe number of sheets at the same position one-sided to their longitudinal direction; and a controller which controls the front/back reversing portion and the sorting portion so as to stack the bank notes in one of the first and second stackers in the state with the front/back and top/bottom arranged uniformly and the front turned upward and in the other stacker with the front/back arranged uniformly and the back turned upward.

Further, according to the embodiment of the present invention, there is provided a bank note processing method comprising inserting plural sheets of rectangular shaped bank notes having the front/back and top/bottom extending along the longitudinal direction of them in a lump; taking out the inserted bank notes with the top or bottom laid ahead one by one; conveying the taken-out bank notes on a prescribed conveying path with the top or bottom laid ahead; detecting information relative to the front/back and top/bottom of the bank notes being conveyed; selectively reversing the front/back of the bank notes being conveyed on the conveying path based on the detected result; sorting the front/back reversed bank notes for either the first or second stacker based on the detected result; banding the bank notes stacked in the first and second stackers for every prescribed number of sheets at the same position one-sided to one of the longitudinal directions of the notes; and controlling the front/back and top/bottom reversing step and the sorting step so as to stack bank notes in the state of the front/back and top/bottom uniformly arranged and the front laid upward in one of the first and second stackers and bank notes in the state of the front/back and top/bottom uniformly arranged and the back laid upward in the other first and second stackers.

BRIEF DESCRIPTION OF THE DRAWINGS

FIG. 9 is a table of kinds tabulated kinds of bank notes classified according to positions of portraits drawn on the bank notes.

DETAILED DESCRIPTION OF THE INVENTION

Preferred embodiments of the present invention will be described below in detail referring to the attached drawings.

Figure 1:
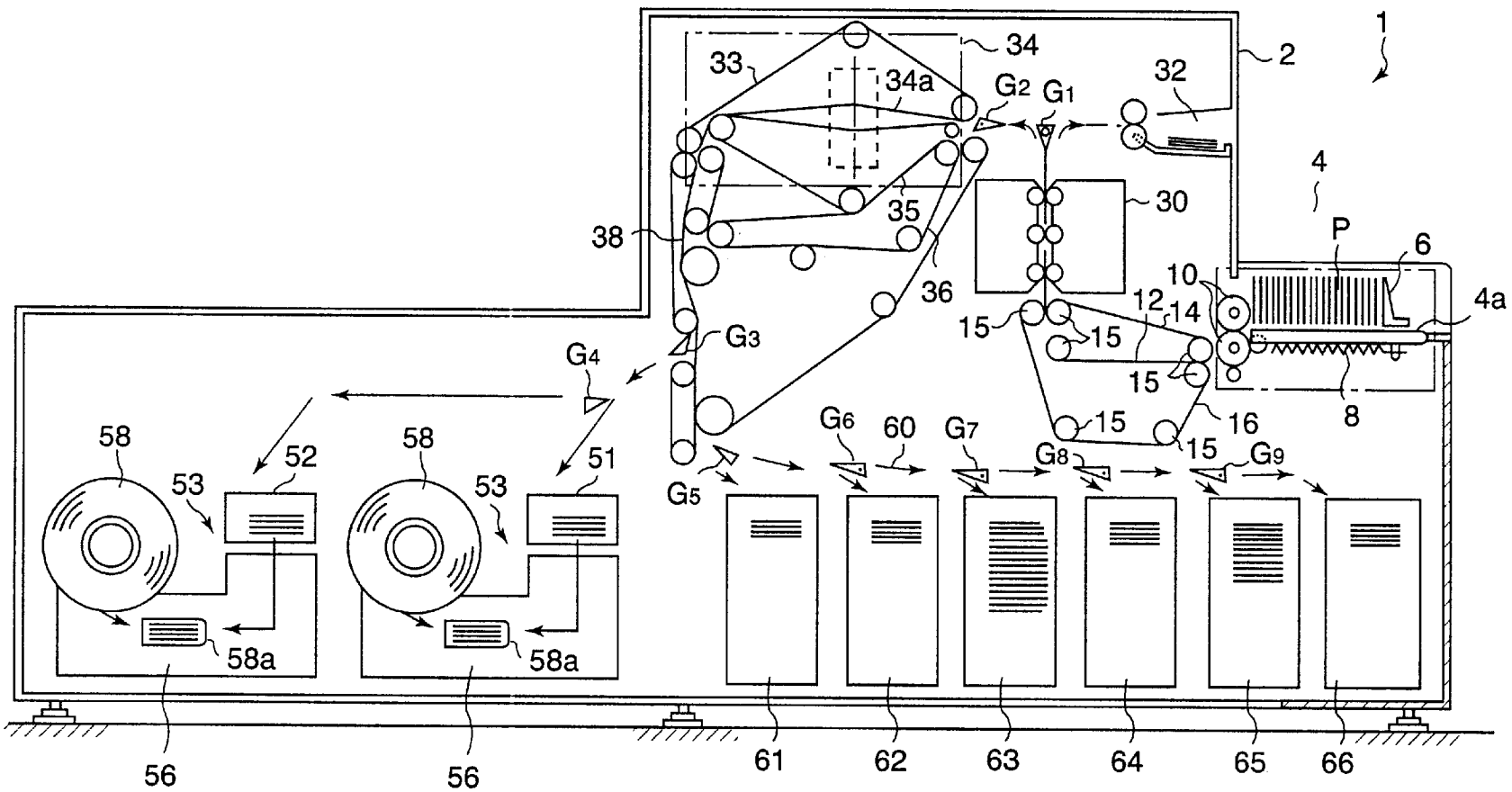
FIG. 1 is a schematic diagram showing the internal structure of a bank note processing apparatus in the embodiments of the present invention.

FIG. 1 schematically shows the internal structure of a bank note processing apparatus 1 involved in preferred embodiments of the present invention. In the bank note processing apparatus 1, plural bank notes in different kinds and sizes are inserted collectively in mix into an insert port. The front and back of all bank notes are arranged uniformly, classified by kind and stacked. The bank note processing apparatus has a function to band bank notes in specific kind only in a prescribed number of sheets by a paper strip.

The bank note processing apparatus 1 has a housing 2, which is an outer casing of the apparatus. On the stepped portion at the right side of the housing 2 shown in the figure, there is provided an insert port 4 into which plural sheets of bank notes P are inserted in a lump in the state of stacked in the face direction and in the erected state are inserted. Bank notes P have the front/back and the top/bottom extending along the longitudinal direction and are inserted into the insert port 4 in the posture of the top or the bottom faced downward. The insert port 4 has a stage 4*a* that arranges all bank notes by contacting the top or the bottom. At the right end of the insert port 4 in the figure, there is provided a backup plate 6 that is erected vertically to the stage 4*a*. The backup plate 6 is provided movably to the left along the stage 4*a* by the force of a spring 8.

Plural sheets of bank notes inserted in the erected state into the insert port 4 are forced to move in the face direction by the backup plate 6 and are moved leftward in the figure. Then, the bank notes P at the left end in the figure is pushed against two sets of take-out rollers 10 (a take-out portion) arranged at the left side in the vertically adjacent state at the left side in the figure. When the take-out rollers 10 are rotated in the prescribed direction, plural sheets of bank notes P inserted into the insert port 4 in the erected posture are taken out on a conveying path 12 in order from a bank note P at the left end. The bank notes P taken out on the conveying path 12 are conveyed in the short direction with the to or bottom laid ahead. At this time, the front/back of the bank notes are not in the uniformly arranged state. In this embodiment, the bank notes P are taken out of the insert port facing downward.

The conveying path 12 is defined by conveying belts 14 and 16 stretched so as to be able to endlessly travel along the conveying direction above and below the conveying path 12. The conveying belts 14 and 16 are wound round plural rollers 15 provided in the cross direction (the bank note surface direction).

At the end of the conveying path 12 that is bent upward by the conveying belts 14 and 16, there is arranged a detector 30 for detecting kind, type, front/back, top/bottom, presence of stain/damage of bank notes P. The detector 30 reads various information from the surfaces of bank notes P conveyed on the conveying path 12, logically calculates the read information, compares with information that become reference and detects features of above-mentioned bank notes P.

By the way, the bank notes P inserted into the insert port 4 are in the state of the front/back and the top/bottom not uniformly arranged and therefore, when taken out on the conveying path 12, the front/back and the top/bottom are not uniformly arranged. So, the front/back and the top/bottom of bank notes P in plural kinds passing through the detector 30 are not uniform.

Figure 2:
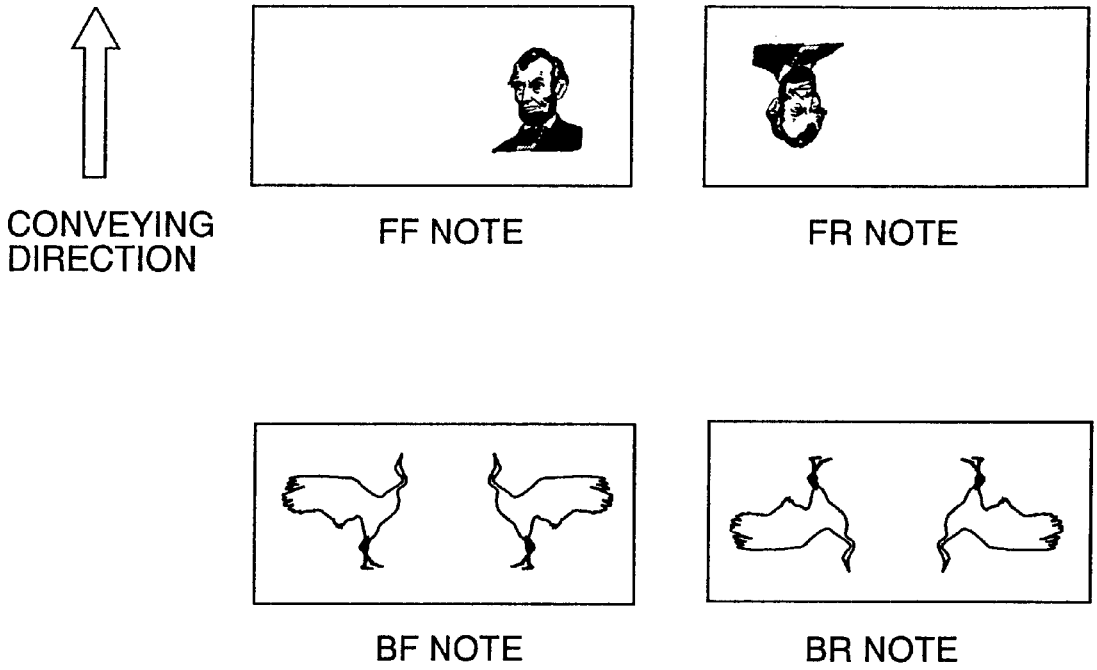
FIG. 2 is a plan view for explaining the directions relative to the front/back and the top/bottom of the bank notes taken out of an insert port.

FIG. 2 illustrates 4 kinds of directions of bank notes P passing through the detector 30 relative to their front/back and the top/bottom. In the following explanation, a bank note P that is taken out with its surface turned upward and the top laid ahead in the conveying direction is called an FF bank note (a second bank note), a bank note taken out with its front surface turned upward and the bottom laid ahead in the conveying direction is called an FR bank note (a first bank note). Further, a bank note P taken out with the back turned upward and the top laid ahead in the conveying direction is called a BF bank note (a third bank note), and a bank note taken out with the back turned upward and the bottom laid ahead in the conveying direction is called a BR bank note (a fourth bank note). In other words, the bank notes conveyed by passing through the detector 30 are conveyed in one of these four conveying postures.

Returning to FIG. 1, on the conveying path 12 extended on the downstream side of the detector 30, plural gates G1–G9 are provided for selectively switching the conveying direction of bank notes P based on the result of detection by the detector 30.

When bank notes of which process at the later stages is judged not practical by the detector 30, including bank notes judged to have been taken in two sheets, judged to have skewed largely exceeding a specified level or damaged, false bank notes (not restricted to bank notes) judged to be not proper bank notes for re-circulation, they are conveyed in the right direction in the figure via the gate G1 and ejected into a rejection box 32. This rejection box 32 is accessible from the outside of the housing 2 of the bank note processing apparatus 1.

On the other hand, bank notes P judged by the detector 30 to be normal bank notes and can be processed are conveyed leftward in the figure to the gate G2 via the gate G1. The bank notes P passed through G1 are in the state of the front/back and top/bottom not uniformly arranged. When these bank notes P with the front/back and top/bottom not uniformly arranged are selectively passed through a front/back reversing mechanism 34, that will be described later, the front/back are properly rearranged, classified and stacked by kind. In this embodiment, all bank notes P are stacked basically with the front sides laid upward.

The conveying path at the downstream side of the gate G2 is branched into two directions and by selectively switching the gate G2 between two positions, the conveying direction of bank notes can be selectively switched in two directions.

On one of the conveying paths branched at the downstream side of the gate G2, the front/back reversing mechanism 34 (the front/back reversing portion) is provided for reversing the front/back of the bank notes P. The conveying path passing through this front/back reversing mechanism 34 forms a twist conveying path 34*a* that is twisted by 180° around the central shaft toward the outlet from the inlet. This twist conveying path 34*a* is composed of two sets of conveying belts 33 and 35 that are in contact with each other in the twisted state. Further, the other conveying path branched at the downstream side of the gate G2 becomes simply a conveying path 36 for passing bank notes P.

Figure 3:
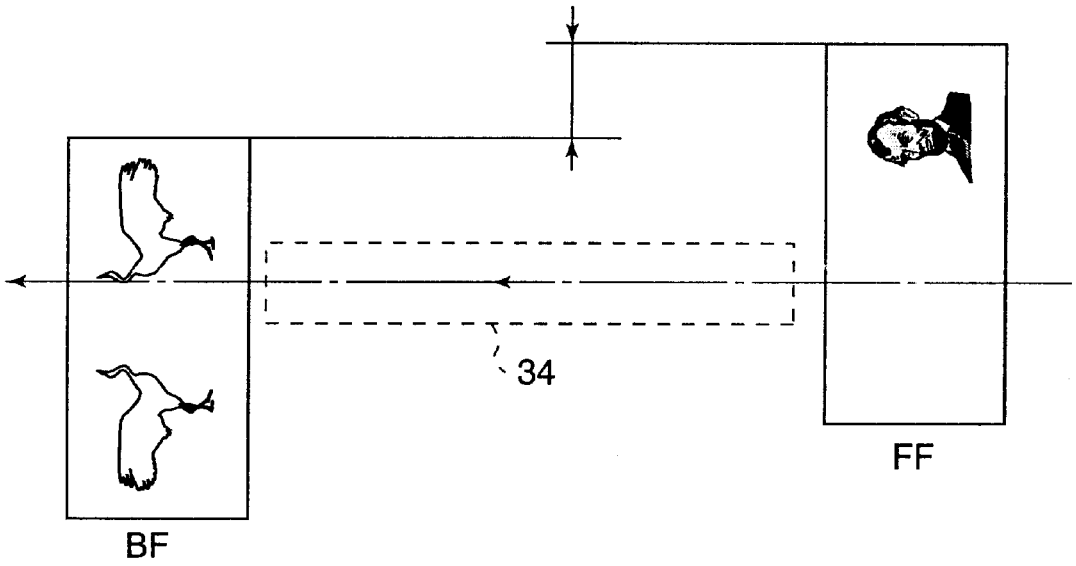
FIG. 3 is a plan view for explaining a front/back reversing operation of bank notes by a front/back reversing mechanism incorporated in the bank note processing apparatus shown in FIG. 1.

Bank notes P that are sorted by the gate G2 and conveyed by the twist conveying path 34*a* of the front/back reversing mechanism 34 are reversed from the front to the back as shown in, for example, FIG. 3. In FIG. 3, the state of bank notes (FF bank notes) conveyed into the front/back reversing mechanism 34 with the front surfaces turned upward and the top laid forward in the conveying direction are reversed and conveyed out of the front/back reversing mechanism 34 as BF bank notes of which back was turned upward is shown.

The bank notes P thus passed through the front/back reversing mechanism 34 and the bank notes passed the conveying path 36 without passing through the front/back reversing mechanism 34 are sent into the gate G3 via a joining portion 38. The length of the conveying path 36 is so set that a process time of the bank notes P to reach the joining portion 38 via the front/back reversing mechanism 34 after passing the gate G2 will become the same as that of the bank notes P to reach the joining portion 38 by passing the conveying path 36. Thus, both the bank notes P conveyed through the front/back reversing mechanism 34 and the bank notes passed through the conveying path 36 pass through the joining portion 38 at the same timing. Accordingly, irrespective of the form of process, all bank notes P can be processed at the same condition.

The conveying path at the downstream side of the gate G3 is branched into two directions and by switching the gate G3, either of two conveying directions of bank notes P can be selected.

One of the conveying paths branched rightward in the figure at the downstream side of the gate G3 forms a horizontal conveying path 60 extending nearly in the horizontal direction above plural stackers 61–66 (a third stacker). Above the horizontal conveying path 60, 5 gates G5–G9 are provided for sorting and stacking conveyed bank notes P in one of 6 stackers 61–69.

Bank notes P selectively sorted by the gate G5 provided at the most upper stream side of the horizontal conveying path 60 are stacked in the stacker 61, bank notes P selectively sorted by the gate G6 are stacked in the stacker 62, bank notes P selectively sorted by the gate G7 are stacked in the gate 63, bank notes P selectively sorted by the gate G8 are stacked in the stacker 64, and bank notes P selectively sorted by the gate G9 are stacked in the stacker 65 or 66.

On the other conveying path branched leftward in the figure at the downstream side of the gate G3, a gate G4 (a sorter) is provided for selectively switching the conveying direction of bank notes P either one of two directions. A banding device 53 is provided at each of two positions branched by the gate G4, respectively. These banding devices 53 are in the solely same structure. Each banding device 53 stacks and bands, for instance, 100 sheets of bank notes P with a paper strip and forms a bundle of bank notes P.

Bank notes P of a specific kind designated for banding by a paper strip 58*a* are sent into these two banding devices 53 according to rules that will be described later. On the other hand, bank notes of other kinds than the specific kind are stacked in the stackers 61–66.

Each banding device 53 has a banding portion 56 for banding every 100 sheets of bank notes P stacked in first and second stackers 51 and 52 conveyed via the gates G3 and G4 with the paper strip 58*a* and a strip supply portion 58 for supplying the paper strip 58*a* that is used in the banding portion 56. Bank papers P of which front/back and top/bottom are uniformly arranged are stacked in the stackers 51 and 52 according to the rules described later. Further, the stacker 51 functions as the first stacker and the stacker 52 functions as the second stacker of this invention. In addition, the banding devices 56 provided corresponding to the stackers 51 and 52 function as the first and second banding portions of this invention.

Bank notes P conveyed into one of the banding devices 53 via the gate G4 are stacked in the stackers 51 and 52 and then, conveyed to the banding portion 56 and banded by the paper strip 58*a* supplied from the strip supply portion 58. Bundles of bank papers P banded for every prescribed number of sheets are conveyed to the outside of the apparatus by a conveyor (not illustrated).

Further, each banding portion 56 receives a prescribed number of bank notes P stacked in the stackers 51 and 52, winds the paper strip 58*a* round the bank notes along the short direction at the position one-sided to the longitudinal direction (the rear side of the bank note processing apparatus 1 in this embodiment) and forms a bundle by banding the prescribed number of bank notes.

Figure 4:
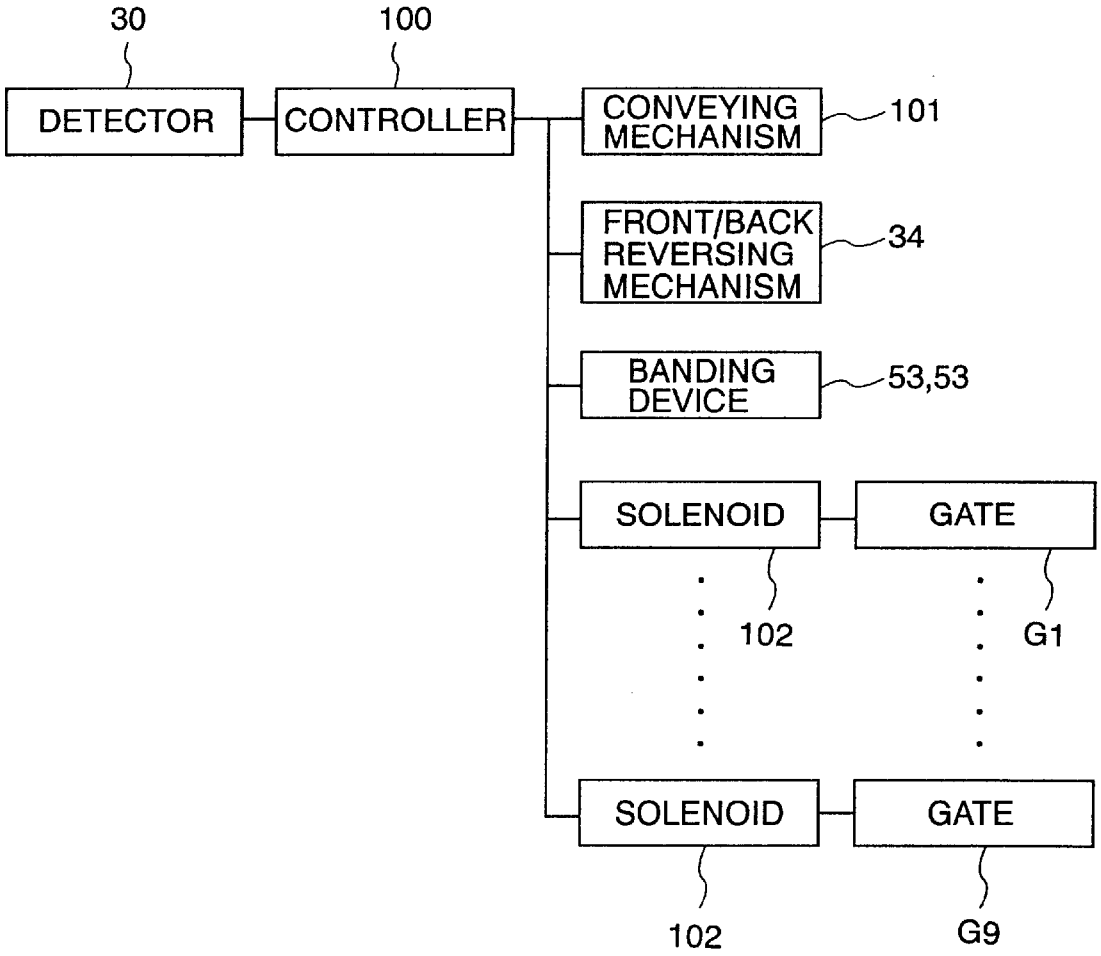
FIG. 4 is a block diagram showing a control system for controlling the process operation of the bank note processing apparatus shown in FIG. 1.

FIG. 4 is a block diagram showing a control system that controls the operation of the bank note processing apparatus 1 described above.

The control system of the bank note processing apparatus 1 has a controller 100 that controls the entire operation of the bank paper processing apparatus 1 according to a pre-set operating program. The controller 100 is connected with a conveying mechanism 101 for conveying bank notes P along a prescribed conveying route by rotating the take-out rollers 10 provided for the insert port 4 and plural rollers provided on the conveying path 12, and plural solenoids 102 for driving plural gates G1–G9 for switching the conveying routes of bank notes P conveyed on the conveying path 12. Further, the detector 30 is connected to the controller 100 for detecting features of bank notes such as kind, front/back, top/bottom, stain, damage, etc. Further, the front/back reversing mechanism 34 for revering the front and back of bank notes P and two banding devices 53 for banding every prescribed numbers of bank notes of specific kind are connected to the controller 100.

Figure 5:
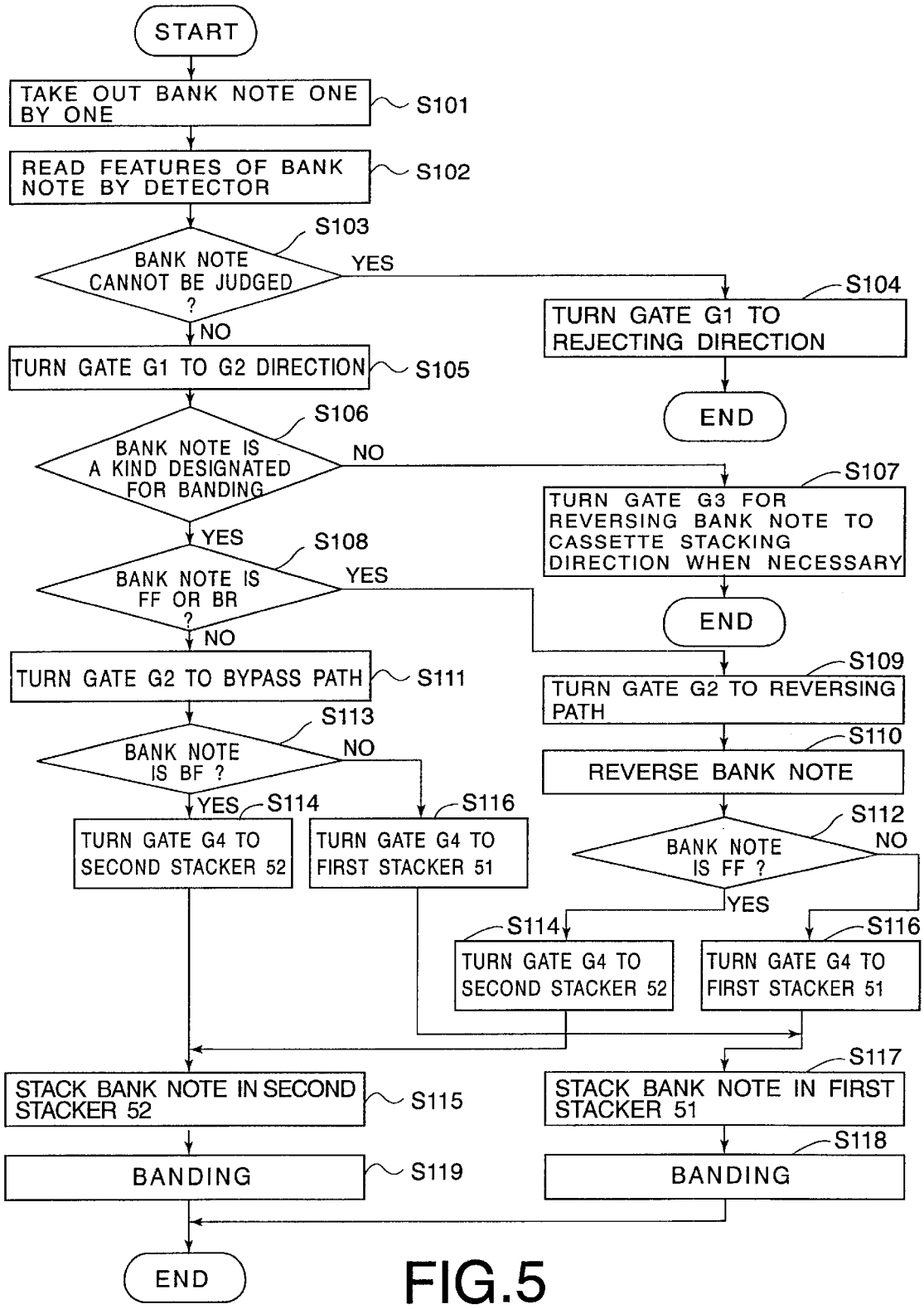
FIG. 5 is a flowchart for explaining a first embodiment of the processing operation by the bank note processing apparatus shown in FIG. 1.
Figure 6:
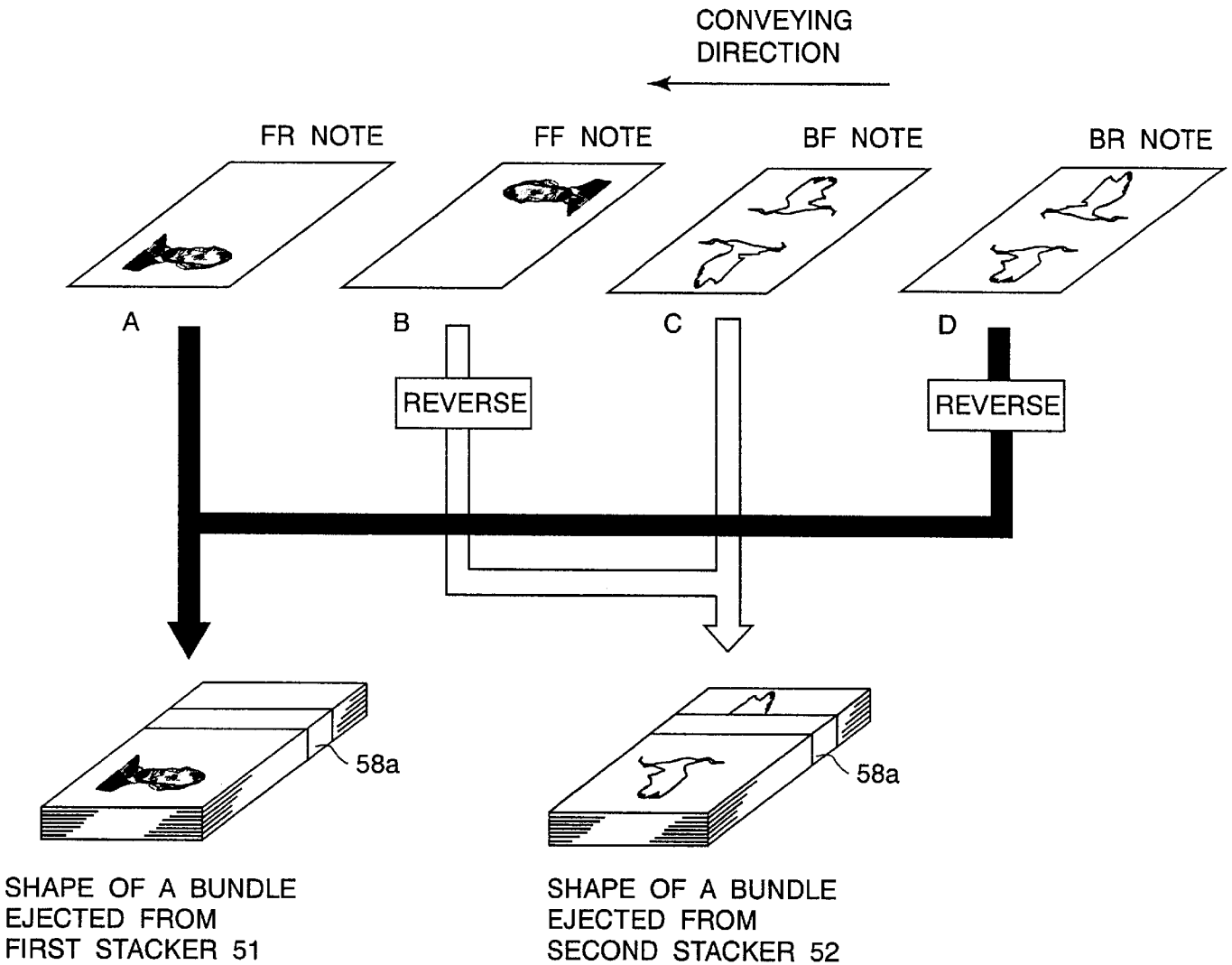
FIG. 6 is a schematic diagram for explaining banding rules of a banding devices incorporated in the bank note processing apparatus shown in FIG. 1.
Figure 7A:
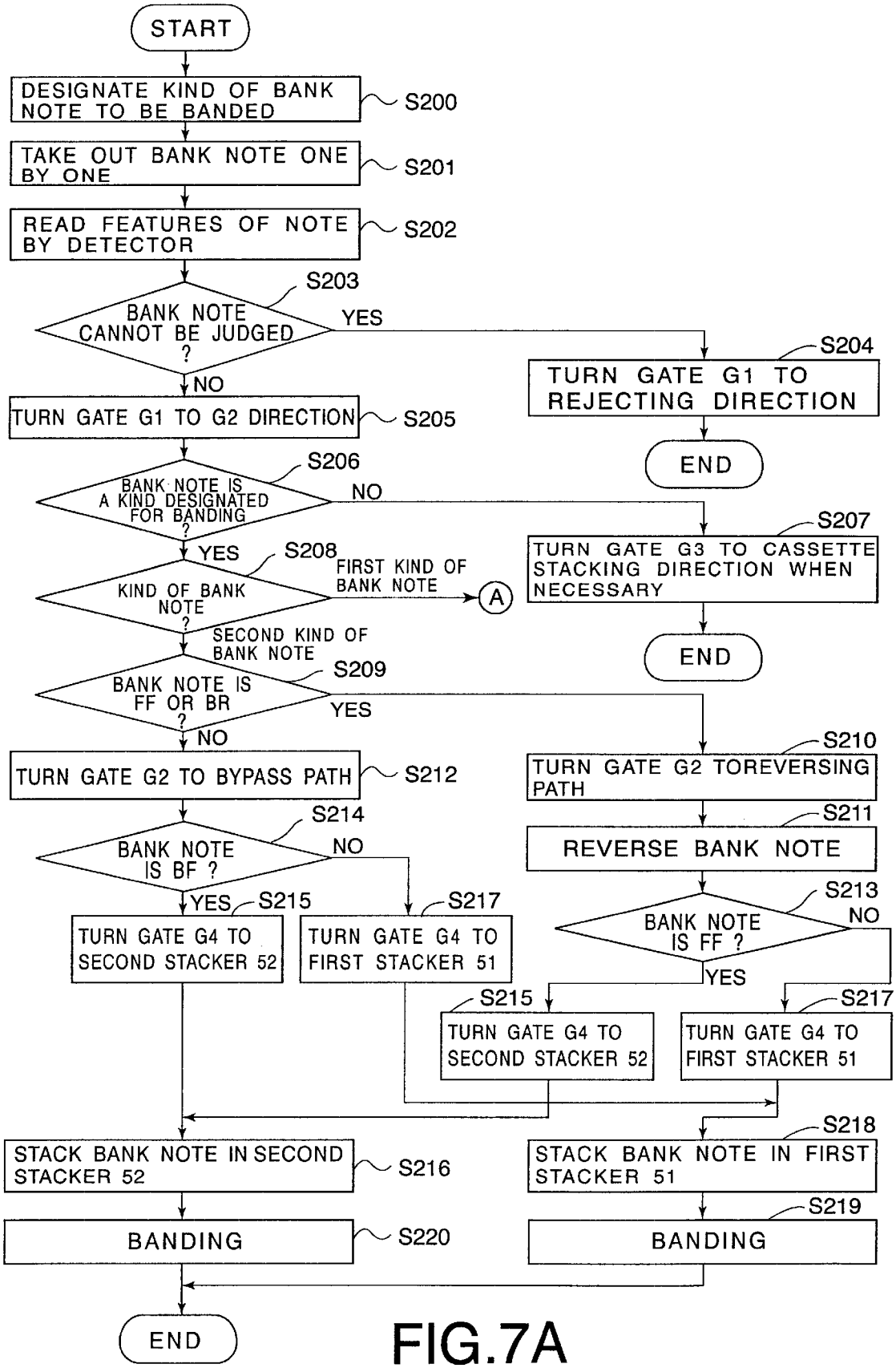
FIG. 7A and FIG. 7B are a flowchart for explaining a second embodiment of the processing operation by the bank note processing apparatus shown in FIG. 1.
Figure 7B:
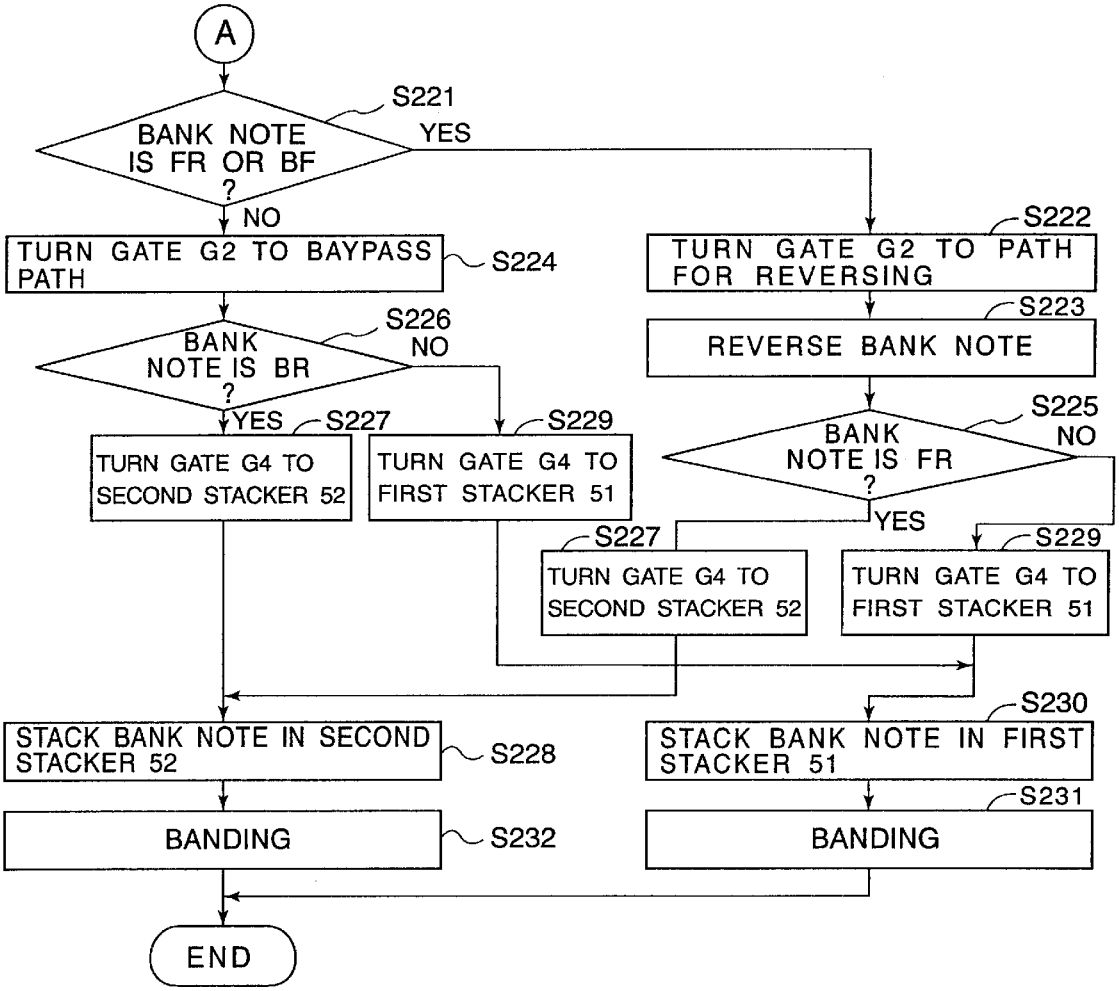

Next, the bank note processing operation of the bank note processing apparatus 1 in the structure described above will be explained referring to FIG. 5 and FIG. 6. FIG. 5 shows a flowchart for explaining the processing operation by the bank note processing apparatus 1. FIG. 6 is an explanatory diagram for explaining the rules for banding bank notes P by two banding devices 53 described above.

First, operator inserts bank notes in plural kinds of money in the unsorted front/back and top/bottom state into the insert port 4 in a lump. Then, a pair of the take-out rollers is rotated and bank notes are taken out on the conveying path 12 one by one in order from bank notes P at the left end (Step 101).

The taken out bank notes are conveyed through the detector 30 in order via the conveying path 12 and the features such as kind, front/back, top/bottom, stain, break, etc. are detected (Step 102).

Based on the result of detection in Step 102, if a bank note P is such a note that cannot be judged (Step 103: YES), the gate G1 is switched to direct the conveying route of that bank paper P to the rejection box 32 (Step 104). Thus, that bank paper P is rejected into the rejection box 32.

On the other hand, when the bank note P is detected to be a proper bank note for re-circulation as a result of the judgment in Step 103 (Step 103: NO), the gate G1 is switched in the direction to the gate G2 (Step 105) and it is judged whether the bank note P is a bank note in the specific kind designated for banding from the kind of the bank note P detected in Step 102 (Step 106).

When the bank note P is judged to be not in the specific kind (Step 106: NO) and that bank note P is being conveyed with the front turned upward as a result of the judgment in Step 106, the gate G2 is switched to the direction to the front/back reversing mechanism 34. Then, the gate G3 is switched to the direction to the horizontal conveying path 60 (Step 107) and the bank notes in the properly arranged front/back (the front is turned upward in this embodiment) passed the joining portion 38 are selectively stacked in the stackers 61–66 corresponding to the kind. At this time, the gate G5–G9 are switched according to the kind of the bank notes P detected in Step 102.

Further, when the bank notes P are judged to be notes in a specific kind in Step 106 (Step 106: YES), based on the result of detection in Step 102, it is further detected whether the bank notes P are FF bank notes being conveyed with the top laid forward and the front turned upward or BR bank notes being conveyed with the bottom laid forward and the back turned upward (Step 108). When the bank notes are detected to be FF or BR notes (Step 108: YES), the gate G2 is switched to the direction to convey the bank notes P to the front/back reversing mechanism 34 (Step 109) and the front/back of the bank notes are reversed (Step 110). On the other hand, when the bank notes P are detected to be not FF or BR notes (that is, FR or BF notes) based on the result of detection in Step 102 (Step 108: NO), the gate G2 is switched in the direction to convey the bank notes toward the conveying path 36 (Step 111) and the bank notes P pass the conveying path 36.

That is, as shown in FIG. 6, the front/back of bank notes P are selectively reversed according to the rules in this embodiment, FF notes become BF notes by reversing the front/back and the BR notes become FR notes by reversing the front/back, and in the subsequent processing all bank notes P directed toward the banding device 53 become FR or BF notes.

In the case of the front/back reversed FF notes (that is, become BF notes)(Step 112: YES) and BF notes passed the conveying path 36 in Step 111 (Step 113: YES), the gate G4 is switched toward the second stacker 52 (Step 114). As a result, the BF bank notes (Step 113: YES) and the FF notes that are reversed and become BF notes in Step 110 (Step 112: YES) are stacked in the second stacker 52 via the gate G4 (Step 115).

In the case of the front/back reversed BR notes (that is, become FR notes) in Step 110 (Step 112: NO) and the FR notes passed the conveying path 36 in Step 111, the gate G4 is switched in the direction of the first stacker 51 (Step 116). As a result, the FR notes (Step 113: NO) and those bank notes that are reversed and become FR notes in Step 110 (Step 112: NO) are stacked in the first stacker 51 via the gate G4 (Step 117).

Thus, bank notes P are stacked in the first and second stackers 51 and 52 with the front/back and top/bottom properly arranged.

Then, the FR notes in a prescribed number of sheets stacked in the first stacker 51 are banded with the paper strip 58*a* in the banding portion 56 (Step 118). The BF notes in a prescribed number of sheets stacked in the second stacker 52 are banded with the paper strip 58*a* in the banding portion 56 (Step 119). At this time, the BF notes with the back turned upward are banded with the paper strip 58*a* at the position one-sided to the rear side of the bank note processing apparatus as shown in FIG. 6. The FR notes with the front turned upward are also banded with the paper strip 58*a* at the position one-sided to the rear side of the apparatus. As a result, therefore, the winding positions of the bundles of bank notes banded with the paper strip 58*a* by the banding devices become the same. That is, when the bundle of the BF notes banded with the back turned upward at the position one-sided to the rear side of the apparatus is reversed, the paper strip 58*a* comes to the side where a portrait is drawn likewise the FR note bundle banded at the position one-sided to the rear side of the apparatus with the front turned upward as shown at the left side of FIG. 6.

As described above, according to the bank note processing apparatus in this embodiment, it is not needed to change the construction of the apparatus wherein the banding position of the paper strip by two banding devices 53 is at the rear side. Accordingly, the front/back and top/bottom of all bank notes P can be uniformly arranged and bank notes with the front turned upward are stacked in one banding device and bank notes with the back turned upward and the top/bottom reversed are stacked in the other bending device. Thus, the winding positions of all bank notes with the paper strip 58*a* can be made uniform.

In this embodiment, the paper strip 58*a* is wound at the position not concealing the portrait portion drawn at the right side of bank notes P. However, instead of not concealing the portrait portion, the portion of kind of bank note, for instance, 1,000-yen, 10,000-yen, etc. is concealed. It is therefore possible to wind bank notes round with the paper strip 58*a* at the portrait portion in the state wherein the portion of face amount of bank note can be seen when necessary. In this case, changing the above-mentioned rules shown in FIG. 6 can solve this problem.

Further, depending on bank notes, the portrait portion is at the left side instead of the right side. In this case, the portion of face amount may be at the right side. This is because the portrait position may differ depending on kind of bank note.

So, a second embodiment of the banding device that is capable of controlling the position to wind the paper strip 58*a* according to a first or a second type of bank notes to wind the paper strip at a position not concealing this portrait portion will be described in detail referring to FIGS. 1, 7A, 7B, 8 and 9.

Operator inserts first, plural bank notes P in plural kinds of money with the front/back and top/bottom not uniformly arranged into the insert port 4. Then, bank notes P to be banded are designated to be, for instance, 10,000-yen notes by operator (Step 200).

FIG. 9 is a table showing a first kind of bank notes with a portrait drawn at the left side and a second kind of bank notes with a portrait at the right side. The first kind of bank notes are "Right Banding" to band them on the right side so as not to conceal the portrait and the second kind of bank notes are "Left Banding" to band them on the left side so as not to conceal the portrait.

Further, as shown in the kind of bank note table in FIG. 9, the 10,000-yen bank notes have the portrait drawn on the bank notes P at the right side. Accordingly, the 10,000-yen bank notes are "Left Banding" that is banded at the right side so that the portrait is not concealed.

The bank notes inserted into the insert port 4 are taken out one by one in order by contact and rotation of a pair of the take-out rollers 10 provided in the insert port 4 (Step 201).

The taken out bank notes P pass through the detector 30 in order and such features of bank notes P as kind, type, front/back, top/bottom, stain, break, etc. of bank notes are detected (Step 202).

When it is detected that a bank note P cannot be judged based on the result of detection in Step 202 (Step 203: YES), the gate G1 is switched to direct the conveying route of that bank note P to the rejection box 32 (Step 204). Then, the bank note P is rejected into the rejection box.

On the other hand, when it is detected that the bank note P is a proper note that can be judged in Step 203 (Step 203: NO), the gate G2 is switched to the direction of the gate G2 (Step 205). Then, from the face value printed on the bank note P detected in Step 202, it is judged whether the bank note P is a 10,000-yen bank note designated for banding (Step 206).

When it is judged that the bank notes are not the kind designated for the banding (Step 206: NO) and that the bank notes P are detected as being conveyed with the front turned upward in Step 202 as a result of the judgment in Step 206, the gage G2 is switched to the direction of the conveying path 36. Or when it is detected that the bank notes P are being conveyed with the back turned upward, the gate G2 is switched in the direction of the front/back reversing mechanism 34 and the front/back of the bank notes are reversed. Then, the gate G3 is switched in the direction of the horizontal conveying path 60 (Step 207) and the bank notes with the front/back uniformly arranged (the front is turned upward in this embodiment) passed through the joining portion 38 are selectively stacked in the stackers 61–66 according to their face values. At this time, the gates G5–G9 are switched according to the face values of the bank notes P detected in Step 202.

Further, when the bank notes P are judged to be the kind designated for the banding in Step 206 (Step 206: YES), the bank notes P are further judged as to whether they are the first kind of notes (for instance, 2,000-yen and 5,000-yen notes) or the second kind of notes (for instance, 1,000-yen and 10,000-yen notes) (Step 208). Here, as it is designated to band the 10,000-yen bank notes in Step 200, the bank notes are regarded to be the second kind of note and the operation goes to Step 209.

In Step 208, the bank notes are detected whether they are FF notes judged to be the second kind of notes and based on the result of detection in Step 202, the bank notes P are being conveyed with the top laid ahead and the front turned upward or BR notes being conveyed with the bottom laid ahead and the back turned upward (Step 209). When the bank notes are detected to be FF notes or BR notes in Step 209 (Step 209: YES), the gate G2 is switched in the direction to convey the bank notes to the front/back reversing mechanism 34 (Step 210), wherein the front/back of the bank notes P are reversed (Step 211). On the other hand, when the bank notes P are detected not to be FF notes nor BR notes (that is, FR notes or BF notes) based on the result of detection in Step 202 (Step 209: NO), the gate G2 is switched in the direction to direct the bank notes P to the conveying path 36 (Step 212) and the bank notes P are conveyed on the conveying path 36.

That is, likewise the first embodiment, by reversing the front/back of the bank notes P according to the rules shown in FIG. 6, the front/back of FF notes are reversed and become BF notes, the front/back of BR notes are reversed and become FR notes. In the subsequent process, all bank notes P directed to the banding device 53 become FR notes or BF notes.

In the case of FF notes of which front/back were reversed (that is, becomes BF notes) in Step 211 (Step 213: YES) and BF notes conveyed on the conveying path 36 in Step 212 (Step 214: YES), the gate G4 is switched in the direction toward the second stacker 52 (Step 215). As a result, BF notes (Step 214: YES) and BF notes that become from FF note as reversed in Step 211 (Step 213: YES) are stacked in the second stacker 52 via the gate G4 (Step 216).

In the case of BR notes of which front/back were reversed (that is, become FR notes) in Step 211 (Step 213: NO) and FR notes passed through the conveying path 36 in Step 212 (Step 214: NO), the gate G4 is switched in the direction toward the first stacker 51 (Step 217). As a result, FR notes (Step 214: NO) and FR notes reversed in Step 211 (Step 213: NO) are stacked in the first stacker 51 via the gate G4 (Step 218).

Thus, the bank notes P are stacked in the first and second stackers 51 and 52 in the state with the front/back and the top/bottom uniformly arranged.

Then, FR notes in a prescribed number of sheets stacked in the first stacker 51 are banded with the paper strip 58*a* in the banding portion 56 (Step 219). BF notes in a prescribed number sheets stacked in the second stacker 52 are banded with the paper stripe 58*a* in the banding portion 56 (Step 220). At this time, BF notes with the back turned upward are wound and banded with the paper strip 58*a* at the position one-sided to the rear side of the apparatus as shown in FIG. 6. FR notes with the front turned upward are also wound and banded with the paper strip 58*a* at the position one-sided to the rear side of the apparatus. In other words, the bank notes are banded at the left side so as not to conceal the portrait portion. As a result, the winding positions of the paper strip 58*a* of bundles of bank notes banded by the banding devices 53 will become the same. That is, when a bundle of BF notes banded with the back turned upward at the position one-sided to the rear side of the apparatus, the paper strip 58*a* is present at the side where no portrait drawn likewise a bundle of FR notes banded at the one-sided position to the rear side of the apparatus (the left side to the front of the note so as not to conceal the portrait portion).

Further, it may become necessary to band, for instance, 2,000-yen notes that were not designated for banding in Step 200 and finally stacked in one of the stackers 61–66. In this case, when the stacked 2,000-yen notes are taken out of the stacker and inserted into the insert port 4 together with bank notes P not yet processed, 2,000-yen bank notes only can be banded.

That is, the operations are the same as those explained for the second embodiment except that 2,000-yen notes are designated for banding in Step 200 and the kinds to be judged is the first kind. Therefore, the explanation of the same portions will be omitted.

As the kinds designated for banding is 2,000-yen notes (Sep 206: YES), 2,000-yen bank notes are judged to be the first kind of note in the judgment of kinds of bank notes in Step 208 when referring to the table of ban note kinds shown in FIG. 9. As the bank notes are judged to be the first kind, the next operation goes to Step 221 shown in FIG. 7B.

Based on the judgment of the first kinds in Step 208 and the result of detection in Step 202, it is detected whether the bank notes P are BF notes being conveyed with the bottom laid ahead and the front turned upward or BF notes being conveyed with the top laid ahead and the back turned upward (Step 221). When the bank notes P are detected to be FR notes or BF notes (Step 221: YES), the gate G2 is switched in the direction to the front/back reversing mechanism 34 (Step 222) and the front/back of the bank notes P are reversed (Step 223). On the other hand, when the bank notes P are not FR notes nor BF notes described above (that is, they are FF notes or BR notes) based on the result of detection in Step 202, (Step 221: NO), the gate G2 is switched in the direction to direct the bank notes P to the conveying path 36 (Step 224) and the bank notes P are conveyed on the conveying path 36.

Figure 8:
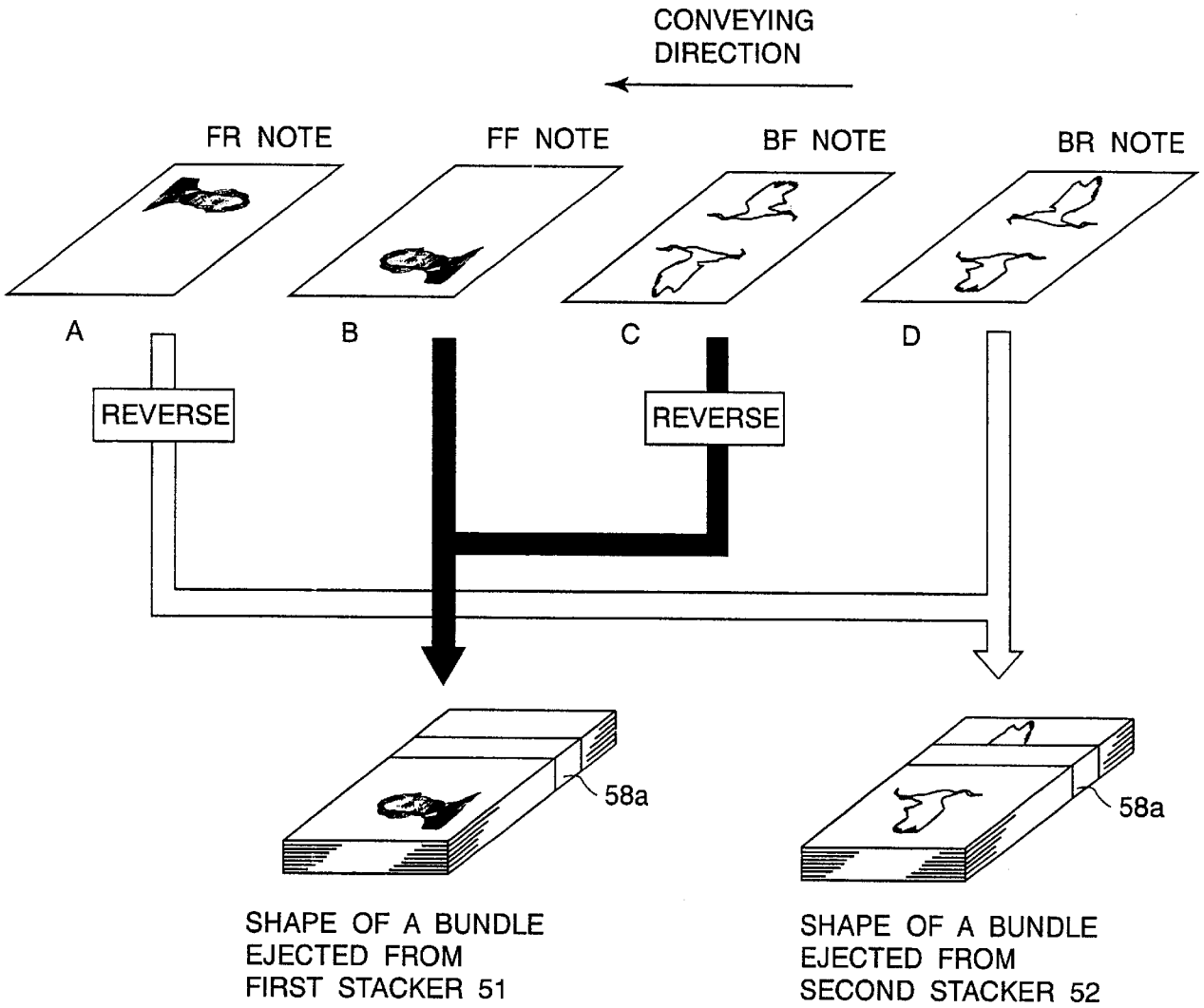
FIG. 8 is a schematic diagram for explaining the banding rules in the second embodiment shown in FIG. 7A and FIG. 7B.

In other words, when the front/back of the bank notes P are selectively reversed according to the rules shown in FIG. 8, FR notes become BR notes and BF notes become FF notes, and in the subsequent process, all bank notes P directed to the banding devices 53 become FF or BR notes.

In the case of FR notes of which front/back are reversed (that is, become BR notes) (Step 225: YES) in Step 223 and BR notes conveyed on the conveying path 36 in Step 224 (Step 226: YES), the gate G4 is switched in the direction to the second stacker 52 (Step 227). As a result, BR notes (Step 226: YES) and BR notes that were reversed and became BR notes in Step 223 (Step 225: YES) are stacked in the second stacker 52 via the gate G4 (Step 228).

In the case of BF notes of which front/back are reversed (that is, become FF notes) (Step 225: NO) in Step 223 and FF notes conveyed on the conveying path 36 in Step 224 (Step 226: NO), the gate G4 is switched in the direction to the first stacker 51 (Step 229). As a result, FF notes (Step 226: NO) and FF notes reversed in Step 223 (Step 225: NO) are stacked in the first stacker 51 via the gate G4 (Step 230).

Thus, the bank notes P are stacked in the first and second stackers 51 and 52 in the state with the front/back and tip/bottom uniformly arranged.

The FF notes in a prescribed number of sheets stacked in the first stacker 51 are banded with the paper strip 58*a* in the banding portion (Step 231). The BR notes in a prescribed number of sheets stacked in the second stacker 52 are banded with the paper strip 58*a* in the banding portion 56 (Step 232). At this time, the BR notes with the back turned upward are wound and banded with the paper strip 58*a* at the position one-sided to the rear side of the apparatus as shown in FIG. 8. The FF notes with the front turned upward are also wound and banded with the paper stripe 58*a* at the position one-sided to the rear side of the apparatus. That is, the bank notes are banded at the right side to the front of the notes so as not to conceal the portrait drawn portion. From this, as a result, the winding positions of the paper strip 58*a* of the bank note bundles by the banding devices 53 become the same. That is, when the bundle of BR notes banded with the back arranged upward at the one-sided position to the rear side of the apparatus is turned over, the paper strip 58*a* is present at the side without the portrait drawn likewise the bundle of FF notes banded at the position (the right side to the front of the notes so as not to conceal the portrait portion) one-sided to the rear side of the apparatus with the front arranged upward as shown at the left side of FIG. 8.

As described above, according to the bank paper processing apparatus in this embodiment, it is not needed to change the structure of the apparatus wherein the paper strip banding position is-set at the rear side of the apparatus in two banding devices 53. Accordingly, the front/back and top/bottom of all bank notes P can be arranged uniformly, and bank notes are stacked in one of the banding devices with the front arranged upward, and stacked in the other banding device with the back arranged upward and with the top/bottom reversed. Thus, the winding positions of the paper strip 58*a* for all bank notes can be uniformly arranged.

Further, the present invention is not restricted to the above-mentioned embodiments but can be varied variously within the scope of the invention.

As described above, the bank note processing apparatus of the present invention has the structure and actions as described above, it is possible to uniformly arrange the front/back and top/bottom of all bank notes without changing the structure from a conventional apparatus and also, band all bank notes at the same positions.

What is claimed is:

1. A bank note processing apparatus comprising:

an insert port into which plural sheets of rectangular shaped bank notes having the front/back and top/bottom extending along the longitudinal direction are inserted collectively;

a take-out portion which takes the bank notes inserted into the insert port one by one with the top or bottom laid ahead;

a conveying path which conveys the bank notes taken out of the take-out portion with the top or bottom laid ahead;

a detector which detects information relative to the front/back and top/bottom of the bank notes being conveyed on the conveying path;

a front/back reversing portion which selectively reverses the front/back of the bank notes being conveyed on the conveying path based on the result of detection by the detector;

first and second stackers which stack the bank notes of which front/back were selectively reversed in the front/back reversing portion;

a sorting portion which sorts the bank notes being conveyed into the first or the second stacker based on the result of detection by the detector;

first and second banding portions which band the bank notes stacked in the first and the second stackers for a prescribe number of sheets at the same position one-sided to their longitudinal direction; and a controller which controls the front/back-reversing portion and the sorting portion so as to stack the bank notes in one of the first and second stackers in the state with the front/back and top/bottom arranged uniformly and the front turned upward and in the other stacker with the front/back arranged uniformly and the back turned upward.

2. A bank note processing apparatus according to claim 1, wherein the controller controls the front/back reversing portion and the sorting portion so as to stack first bank notes detected by the detector as being conveyed with the bottom laid ahead and the front turned upward in the first stacker without reversing the front/back, second bank notes detected by the detector as being conveyed with the top laid ahead and the front turned upward in the second stacker after reversing its front/back, third bank notes detected as being conveyed with the top laid ahead and the back turned upward in the second stacker without reversing the front/back, and a fourth bank note detected by the detector as being conveyed with the bottom laid ahead and the back turned upward in the first stacker after reversing the front/back by the front/back reversing portion.

3. A bank note processing apparatus according to claim 1, the controller controls the front/back reversing portion and the sorting portion so as to stack first bank notes detected by the detector as being conveyed with the top laid ahead and the front turned upward in the first stacker without reversing its front/back, second bank notes detected by the detector as being conveyed with the bottom laid ahead and the front turned upward in the second stacker after reversing the front/back by the front/back reversing portion, third bank notes detected by the detector as being conveyed with the bottom laid ahead and the back turned upward in the second stacker without reversing the front/back, and fourth bank notes detected by the detector as being conveyed with the top laid ahead and the back turned upward in the first stacker after reversing the front/back by the front/back reversing portion.

4. A bank note processing apparatus according to claim 1, wherein bank notes that are inserted into the insert port include plural kinds of money and bank notes in plural kinds of face values are inserted into the insert port in mix.

5. A bank note processing apparatus according to claim 4, wherein the detector further detects kind of face values of bank notes.

6. A bank note processing apparatus according to claim 5, wherein the first and second stackers stack bank notes in specific kinds of face values detected by the detector.

7. A bank note processing apparatus according to claim 6, wherein the sorting portion sorts the bank notes in specific kinds of face values conveyed on the conveying path to either the first or the second stacker.

8. A bank note processing apparatus according to claim 7 further comprising:

at least one unit of a third stacker for stacking bank notes in face values other than that of specific kind by kind.

9. A bank note processing apparatus according to claim 6, wherein the controller controls the front/back reversing portion and the sorting portion so as to stack first bank notes detected by the detector to be in specific kind and as being conveyed with the bottom laid ahead and the front turned upward in the first stacker without reversing the front/back, second bank notes detected by the detector to be in specific kind and as being conveyed with the top laid ahead and the front turned upward in the second stacker after reversing the front/back by the front/back reversing portion, third bank notes detected by the detector to be in specific kind and as being conveyed with the top laid ahead and the back turned upward in the second stacker without reversing the front/back, and forth bank notes detected by the detector to be in specific kind and as being conveyed with the bottom laid ahead and the back turned upward in the first stacked after reversing its front/back.

10. A banknote processing apparatus comprising:

an insert port into which plural sheets of rectangular shaped bank notes having the front/back and top/bottom extending along the longitudinal direction in a lump;

a setting portion which sets a banding position of bank notes at a position one-sided to one of the longitudinal directions of bank notes by kind;

a take-out portion which takes out the bank notes inserted into the insert port by one by one with the top or bottom laid ahead;

a conveying path which conveys the bank notes taken out of the take-out portion with the top or bottom laid ahead;

a detector which detects information relative to the front/back and top/bottom of the bank notes being conveyed on the conveying path;

a front/back reversing portion which selectively reverses the front/back of the bank notes being conveyed on the conveying path based on the result of detection by the detector and the set contents by the setting portion;

first and second stackers which stack the bank notes of which front/back are selectively reversed in the front/back reversing portion;

a sorting portion which sorts the bank notes being conveyed on the conveying path to either the first or second stackers based on the result of detection by the detector and the set contents of the setting portion;

first and second banding portions which band the bank notes stacked in the first and second stackers at the same position one-sided to one of the longitudinal directions of the notes; and a controller which controls the front/back reversing portion and the sorting portion so as to stack bank notes in the state of the front/back and top/bottom uniformly arranged and the front laid upward in one of the first and second stackers; and stack bank notes in the state of the front/back and top/back uniformly arranged and the back laid upward in the another stacker.

11. A bank note processing method comprising:

inserting plural sheets of rectangular shaped bank notes having the front/back and top/bottom extending along the longitudinal direction of them in a lump;

taking out the inserted bank notes with the top or bottom laid ahead one by one;

conveying the taken-out bank notes on a prescribed conveying path with the top or bottom laid ahead;

detecting information relative to the front/back and top/bottom of the bank notes being conveyed;

selectively reversing the front/back of the bank notes being conveyed on the conveying path based on the detected result;

sorting the front/back reversed bank notes for either the first or second stacker based on the detected result;

banding the bank notes stacked in the first and second stackers for every prescribed number of sheets at the same position one-sided to one of the longitudinal directions of the notes; and controlling the front/back and top/bottom reversing step and the sorting step so as to stack bank notes in the state of the front/back and top/bottom uniformly arranged and the front laid upward in one of the first and second stackers and bank notes in the state of the front/back and top/bottom uniformly arranged and the back laid upward in the other first and second stackers.

12. A bank note processing method according to claim 11, wherein the controlling step controls the front/back reversing step and the sorting step so as to stack first bank notes detected in the detecting step as being conveyed with the bottom laid ahead and the front turned upward in the first stacker without reversing the front/back, second bank notes detected in the detecting step as being conveyed with the top laid ahead and the front turned upward in the second stacker after reversing in the front/back reversing step, third bank notes detected in the detecting step as being conveyed with the top laid ahead and the back turned upward in the second stacker without reversing the front/back, and fourth bank notes detected in the detecting step as being conveyed with the bottom laid ahead and the back turned upward in the first stacker after reversing in the front/back reversing step.

13. A bank note processing method according to claim 11, wherein the controlling step controls the front/back reversing step and the sorting step so as to stack the first bank notes detected in the detecting step as being conveyed with the top laid ahead and the front turned upward in the first stacker, the second bank notes detected in the detecting step as being conveyed with the bottom laid ahead and the front turned upward in the second stacker after reversing in the front/back reversing step, the third bank notes detected in the detecting step as being conveyed with the bottom laid ahead and the back turned upward in the second stacker without reversing the front/back, and the fourth bank notes detected in the detecting step as being conveyed with the top laid ahead and the back turned upward in the first stacker after reversing in the front/back reversing step.

14. A bank note processing method comprising:

inserting plural sheets of rectangular shaped bank notes having the front/back and top/bottom extending along the longitudinal direction of them in a lump;

taking out the inserted bank notes with the top or bottom laid ahead one by one;

conveying the taken-out bank notes on a prescribed conveying path with the top or bottom laid ahead;

detecting information relative to kind, front/back and top/bottom of the bank notes being conveyed;

selectively reversing the front/back of the bank notes being conveyed on the conveying path based on the detected result;

sorting bank notes in specific kind out of the bank notes of which front/back were reversed for either the first and second stackers based on the detected result;

stacking the bank notes detected to be other than the bank notes in specific kind in the detecting step by kind;

banding the bank notes stacked in the first and second stackers for every prescribed number of sheets at the same position one-sided to one of the longitudinal directions of the notes; and controlling the front/back and top/bottom reversing step and the sorting step so as to stack bank notes of specific kind in the state of the front/back and top/bottom uniformly arranged and the front turned upward in the first stacker or the second stacker and bank notes in the state of the front/back and top/bottom uniformly arranged and the back turned upward in the other stacker.

15. A bank note processing method according to claim 14, wherein the controlling step controls the front/back reversing step and the sorting step are so as to stack the first bank notes detected in the detecting step as being in the specific kind and conveyed" with the bottom laid ahead and the front turned upward in the first stacker without reversing the front/back, the second bank notes detected in the detecting step as being in the specific kind and conveyed with the top laid ahead and the front turned upward in the second stacker after reversing in the front/back reversing step, the third bank notes detected in the detecting step as being in the specific kind and conveyed with the top laid ahead and the back turned upward in the second stacker without reversing the front/back, and the fourth bank notes detected in the detecting step as being in the specific kind and conveyed with the bottom laid ahead and the back turned upward in the first stacker after reversing in the front/back reversing step in the first stacker.

* * * * *